US006311681B1

(12) United States Patent
Snyder, Jr.

(10) Patent No.: US 6,311,681 B1
(45) Date of Patent: Nov. 6, 2001

(54) MULTI-PORT PAINTBALL PROJECTOR

(75) Inventor: Earl C. Snyder, Jr., Bedford, NH (US)

(73) Assignee: First Shot PB, INC, Woodbridge, NJ (US)

( * ) Notice: Subject to any disclaimer, the term of this patent is extended or adjusted under 35 U.S.C. 154(b) by 0 days.

(21) Appl. No.: 09/541,066

(22) Filed: Mar. 31, 2000

(51) Int. Cl.[7] ..... F41B 11/00
(52) U.S. Cl. ..... 124/59
(58) Field of Search ..... 124/59, 72, 71; 89/1.41

(56) References Cited

U.S. PATENT DOCUMENTS

| | | | | |
|---|---|---|---|---|
| D. 353,853 | | 12/1994 | Albritton | D21/145 |
| D. 359,529 | | 6/1995 | Nguyen | D21/147 |
| 5,097,816 | | 3/1992 | Miller | 124/49 |
| 5,282,455 | * | 2/1994 | Adamson et al. | 124/59 |
| 5,327,878 | | 7/1994 | Wittbrot | 124/41.1 |
| 5,448,951 | | 9/1995 | Olson | 102/513 |
| 5,727,538 | | 3/1998 | Ellis | 124/77 |
| 5,823,173 | | 10/1998 | Slonaker et al. | 124/56 |
| 5,881,707 | | 3/1999 | Gardner, Jr. | 124/77 |
| 5,896,850 | | 4/1999 | Sullivan, Jr. | 124/74 |
| 5,904,133 | | 5/1999 | Alexander et al. | 124/73 |
| 5,924,413 | * | 7/1999 | Johnson et al. | 124/72 |
| 6,152,125 | * | 11/2000 | Piper | 124/59 |

* cited by examiner

*Primary Examiner*—Peter M. Poon
*Assistant Examiner*—Kevin Jakel
(74) *Attorney, Agent, or Firm*—Walter A. Hackler

(57) ABSTRACT

A paintball launching device generally includes a launch head having a plurality of ports therein, each port being adapted to receive a paintball. A launching mechanism, including a connector for coupling the launch head to a source of compressed gas, is provided. A manifold within the launch head provides a flow path for expansion of the compressed gas upon activation of the device, causing the paintballs to be simultaneously propelled from the ports.

23 Claims, 4 Drawing Sheets

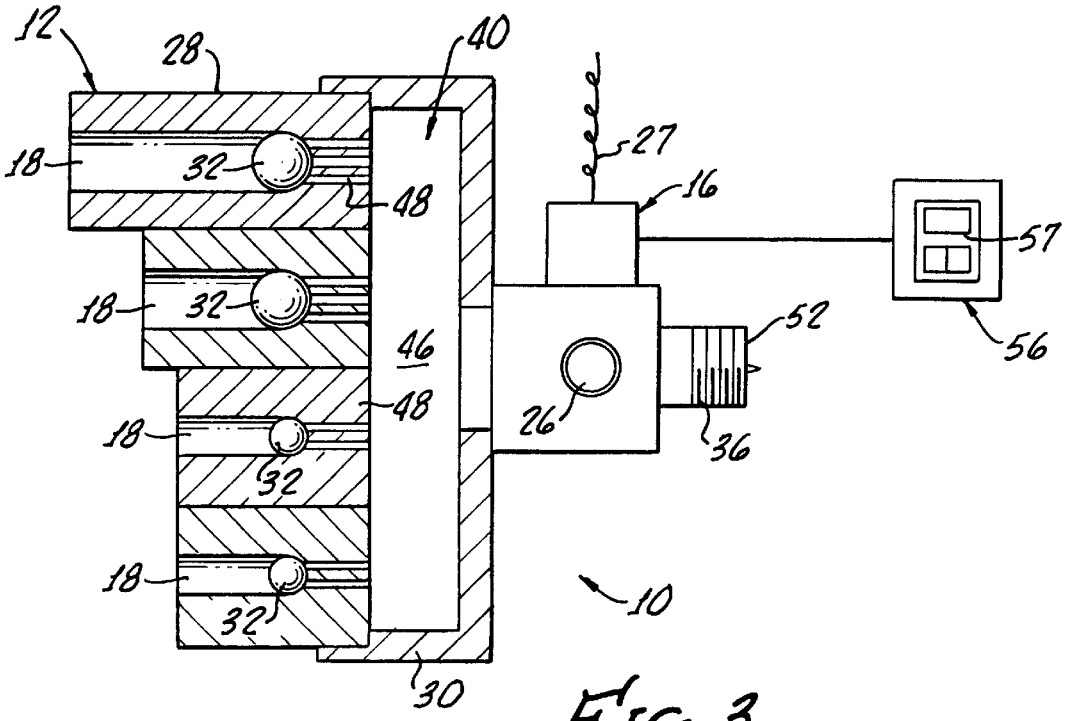
FIG. 3.
FIG. 5.
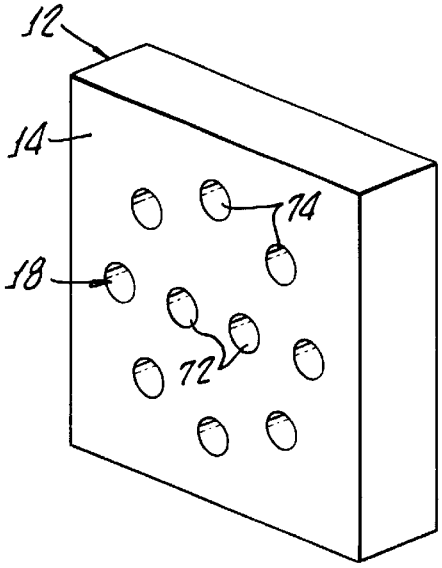
FIG. 6.
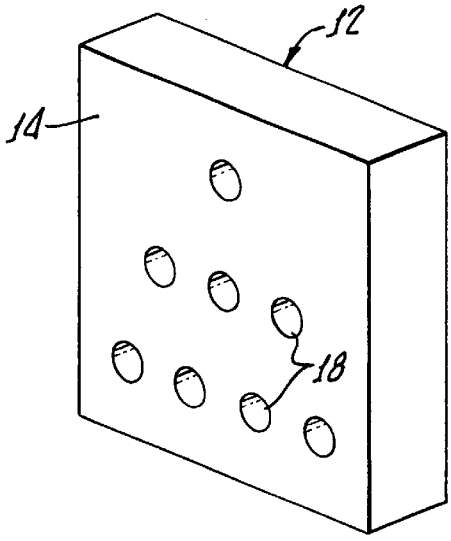

MULTI-PORT PAINTBALL PROJECTOR

The present invention generally relates to a paintball gun for use in sporting and recreational activities, and specifically relates to a multi-port paintball gun.

Paintball guns which use pneumatic force to propel a projectile, specifically a "paintball", at a target or opponent, are well known. A paintball is a fragile, generally spherical shell containing a colored, viscous, nontoxic paint. Paintball guns have long been used for recreation activities, as well as combat training purposes.

The present invention is specifically directed toward a recreational paintball gun, for example, for use in the popular recreational game known as simply "Paintball" or "Survival", in which teams of competitors, or individual competitors, are supplied with paintball guns and a number of paintballs for use as ammunition. When a competitor is hit with a paintball fired from a gun, the paintball ruptures, leaving dramatic, colorful evidence of the hit, without substantially injuring the competitor. Such games have become enormously popular in recent years and improved variations of both paintball guns, and paintballs, have been developed. Conventional paintball guns typically fire paintballs using bursts of compressed air, $CO_2$ or nitrogen.

Notably, it is not uncommon for a quarter million balls to be fired in a single, large scale game of "Paintball", indicating that a paintball launching device which facilitates rapid, high quantity discharge of paintballs would be desirable. This is one object of the present invention.

Paintball guns have been developed which enable rapid and successive firing of paintballs. These guns add to the level of excitement of the game by enabling an player to fire at several competitors which may be simultaneously approaching the player's flag or protected basecamp. Ideally, the successive firing gun will operate to rapidly discharge successive paintballs without need for the operator to reload the gun between successive shots. In general, successive firing paintball guns are operated by first feeding a supply of paintballs, i.e. a "round", into a storage compartment or "magazine". Individual paintballs descend along a feed path into a firing chamber and are successively discharged by the participant as needed. Firing of the gun is initiated by "cocking" a striker by use of a manual cocking pin, and pressing a trigger to cause a short burst of compressed air into the firing chamber holding the individual paintball, thereby propelling the paintball down a barrel of the gun and toward the target competitor.

One well known problem with conventional paintball guns with successive firing function is that individual paintballs do not always smoothly descend into the firing chamber, or they may roll move out of position. In some instances, the paintballs may become jammed as the operator attempts to fire the gun. It is known that such malfunction of the gun will sometimes cause the fragile paintballs to tear and spill liquid paint into the gun interior, resulting in frustration for the operator during the game where, as can be appreciated, timing is critical.

Although paintball guns have been developed with the object of correcting these and other problems with conventional paintball guns, there is still a need for an improved paintball gun which will add new variety and excitement to the game without merely improving on the successive firing function of conventional guns.

SUMMARY OF THE INVENTION

Accordingly, this is a primary object of the present invention. The present invention provides a useful paintball launching device which enables simultaneous expulsion of multiple paintballs by means of a single actuation thereof. In addition, the invention provides a launching device capable of launching multiple paintballs in a distinct, preselected discharge pattern, or alternatively, in a random discharge pattern.

Generally, the device comprises a launch head, a launching mechanism providing paintball expulsion means, and a controller. A plurality of ports are defined in said launch head, each port being adapted to receive a paintball.

In a preferred embodiment, the launch head includes one substantially planar face in which the ports are disposed in a selected pattern. For example, the multiple ports may be disposed in a side by side relationship within the face, with each port being substantially parallel to one another. Alternatively, the ports may be disposed at angles to one another, for example, at divergent or convergent angles to effect a wide dispersion or a relatively focused dispersion of paintballs respectively.

On the launch head face, the ports may define a generally linear pattern, a matrix pattern, a circular pattern or an angular pattern. Depth of the ports may be selected to provide a predictable range of flight of the paintballs. Each port pattern and port depth may provide distinct advantages in the playing field.

Other possible launch head designs are contemplated. For example, the launch head may be provided with a plurality of angulated faces with each face including one or more ports therein. Rather than a planar face, the launch head may include a concave or convex face having corresponding angulated ports.

One feature of the invention provides a launch head having a base member and a plurality of interchangeable cartridges adapted to be snap fitted to the base member. The base member may be adapted to engage two or more cartridges at a time.

The present invention is preferably pneumatically powered and includes means for coupling the device to a source of compressed gas. The source of compressed gas may be connected to the plurality of ports by means of a manifold integrated into the launch head.

BRIEF DESCRIPTION OF THE DRAWINGS

The objects and advantages of the present invention will be more clearly understood with reference to the following Detailed Description when considered in conjunction with the following Drawings of which:

FIG. 3 shows a cross sectional view of the launch head of FIG. 2, taken along line 3—3 of FIG. 2;

FIGS. 5 and 6 show alternative faces of the launch head wherein the plurality of ports define a circular pattern and a triangular pattern, respectively;

DETAILED DESCRIPTION OF THE INVENTION

Figure 1:
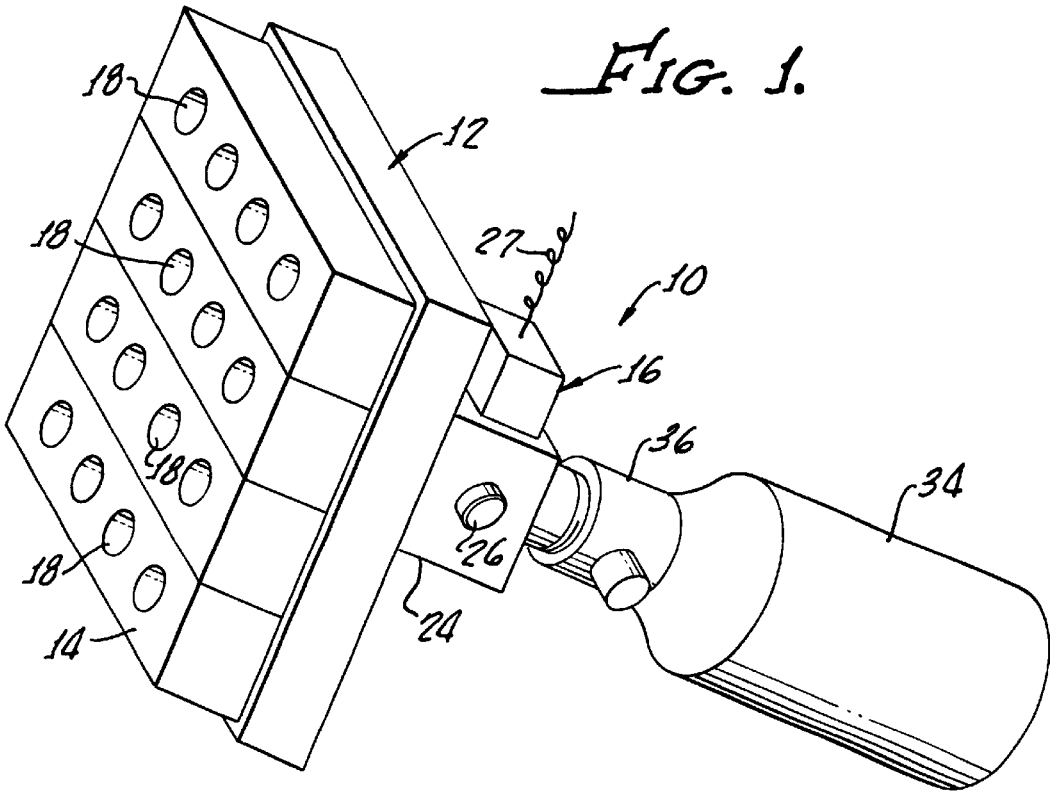
FIG. 1 shows a perspective view of an embodiment of a paintball launching device in accordance with the invention, including a launch head having a face and multiple ports for receiving paintballs as well as means for launching the paintballs therefrom.

Turning now to FIG. 1, a paintball launching device, in accordance with the present invention, is shown generally at 10. The device 10 generally comprises a launch head 12 having a face 14, and a controller 16. The launch head 12 includes a plurality of ports 18 disposed in the face 14, each individual port 18 being adapted to receive a paintball (not shown in FIG. 1.) Additionally, the device 10 comprises a launching mechanism 24, disposed in an operative relationship with the launch head 12 as means for propelling each paintball from its respective port 18. The controller 16 is adapted to enable operator controlled actuation of the launching mechanism 24 and may be provided by a simple manual push button 26, or a more complex assembly including signal receiving means 27 enabling remote control of the device 10. Advantageously, as will be described in detail hereinafter, the present paintball launching device 10 is designed to enable multiple paintballs to be simultaneously launched toward a target (not shown).

The launch head 12 may be made of any suitable metal or plastic, and the ports 18 are made by machine boring. The bores 18 are then each wet polished and buffed to a high polish or mirror surface finish of about 16 RMS finish or better.

Figure 2:
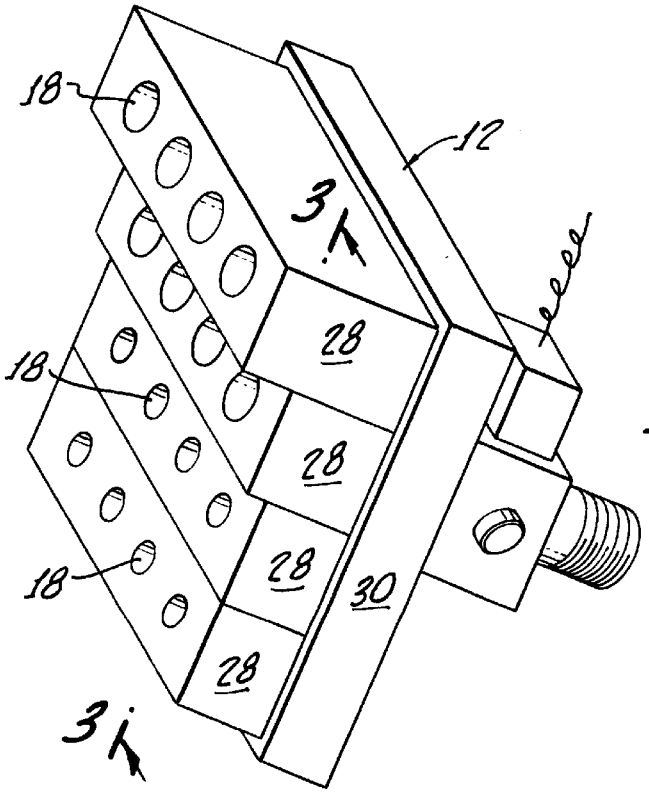
FIG. 2 shows an alternative type of the launch head shown in FIG. 1 having removable and interchangeable paintball cartridges.

Turning now as well to FIG. 2, in one embodiment of the present invention, the launch head 12 may be comprised of one or more cartridges 28 removably and interchangeably coupled to a base member 30. Each cartridge 28 includes at least one port 18 for receiving a paintball.

In addition, the base member may be adapted to accommodate two or more cartridges 28 at a time such as shown in FIG. 2, in which four different cartridges 28 are coupled with the base member 30. Each cartridge 28 may be secured to the base member 30 by snap fit engagement.

FIG. 3 shows a cross sectional view of the device 10 in which a paintball has been inserted into each port 18. Paintballs of various sizes are commercially available. Preferably, the ports 18 of the present invention are sized accordingly to accommodate a commercially manufactured paintball 32. Paintballs are typically made of an elastin, gelatinous capsule filled with liquid paint, and are thus deformable. The ports 18 may therefor be made to be slightly smaller in diameter than the paintball itself to assure that the paintball is easily insertable into the port 18 but will be securely held therein prior to discharge. In FIGS. 2 and 3, cartridges 28 having different port diameters are shown, corresponding to different sized paintballs 32.

Preferably, the present device 10 operates by pneumatic means, for example, by means of compressed gas expulsion. For example, (as shown in FIG. 1) a cylinder 34 of carbon dioxide, nitrogen or compressed air may be connected to the launching mechanism 24 by a suitable coupling member 36. Other possible launching mechanisms are contemplated, for example, the use of spring mechanisms or other mechanical means (not shown).

In the preferred embodiment, the launch mechanism 24 includes a manifold 40 within the launch head 12. The manifold 40 may include a plenum 46, defined for example by the base member 30, and multiple flow lines 48 connecting the plenum 46 to each of the ports 18.

The "call for launch", a term understood by those skilled in the art, is initiated by manually pressing the trigger or button 26, which operates a valve member 52 coupled to the source of compressed gas, thereby allowing a burst of the compressed gas to be introduced into the plenum 46 and rapidly expanded through the manifold 40. Dissipation of the gas from an initial pressure of about 50 atmospheres causes expulsion of the paintballs 32 from the ports 18 with velocity dependent on paintball size, port depth and other factors understood by those skilled in the art.

With appropriate modification to the present device as described, other expulsion means are also possible, including an electropneumatic valve utilizing a battery device for providing power thereto.

In lieu of, or in addition to, the push button actuator 26, the device 10 may be designed to enable remote controlled launching of paintballs 32. For example, the controller 16 may include a remote actuator 56, including a key pad 57, capable of transmitting signals, for example radiowave signals, to the receiver 27 mentioned briefly hereinabove, said receiver being adapted to respond to the signals by activating the launch of paintballs from the launch head 12. The remote actuator 56 and receiver 27 may be of any conventional design.

The device 10 may further comprise means for enabling launch of paintballs having different ranges of flight. It will be appreciated that there are many different ways to modify the launch head and/or launching mechanism to accomplish this, a few examples being described hereinafter. For example, a depth of the port 18 can be modified to effect a desired launch velocity, and thus a desired range of flight. Generally, a longer port depth will effect a higher launch velocity relative to a shorter port depth. Thus, still referring to FIG. 3, it is shown that different length ports 18 may be provided in the launch head 12 to effect different of flight ranges, i.e. distances from a point of expulsion, of the multiple paintballs. Advantageously, by providing various port depths in a single launch head 12 (or several cartridges 28 each having distinct port depths) actuation of the device 10 will result in a spray of multiple paintballs over a wide distance.

Alternatively, the means for enabling launch of paintballs with different ranges may comprise different length flow lines 48 and/or flow lines of different diameters to effect the force of propulsion behind each paintball. In addition still, the means for enabling launch of paintballs with different ranges of flight may comprise ports 18 of different diameters for accommodating different size paintballs 32.

Figure 4:
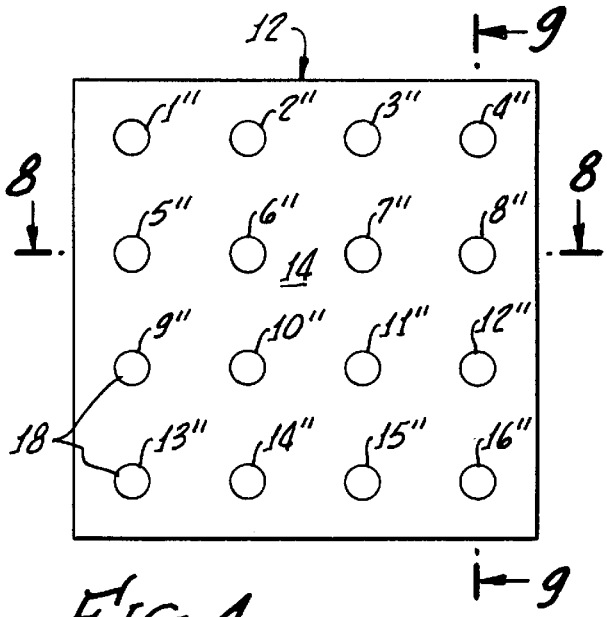
FIG. 4 shows a front view of a launch head face wherein the plurality of ports define a 4×4 matrix in the face.

Turning now to FIGS. 4–6, the ports 18 may be disposed in a side by side relationship within the launch face 14, for example to form an array or matrix of ports 18 such as the 4×4 matrix shown in FIG. 4. Alternatively, the ports 18 may be disposed in a substantially circular pattern or a substantially triangular pattern, as shown in FIGS. 5 and 6 respectively.

A player/operator may select a launch head 12 having a desired port arrangement after considering various factors such as size of a playing field, the number of opponents (potential targets) and even the positions of advancing opponents in the playing field, particularly when the device 10 includes the interchangeable cartridge 28 feature described hereinabove. In the same respect, the device 10 may be made available with several different designs for suiting different games, different rules of play, number of players, etc. It should be appreciated therefor that many other arrangements are possible and that the examples shown and described herein are not to be considered limiting of the scope of the present invention.

Figure 7:
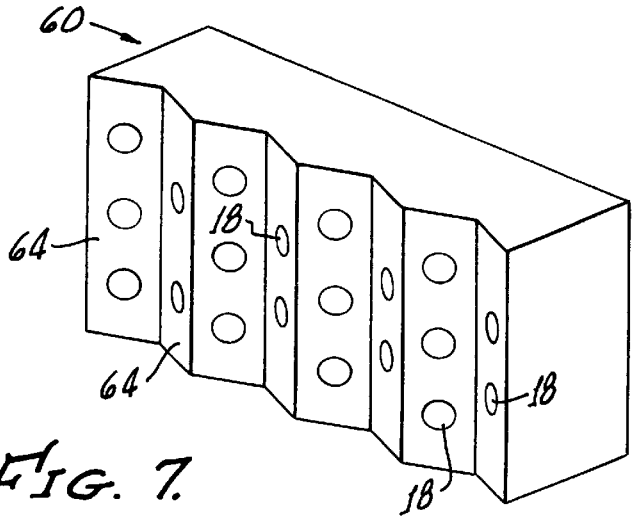
FIG. 7 shows an alternative launch head having multiple angulated faces and a selected number or arrangement of ports within each of the angulated faces.

An alternative launch head 60 is shown in FIG. 7, wherein the launch head 60 includes a plurality of faces 64 disposed at angles to one another, and the plurality of ports 18 are disposed in the angulated faces 64. As shown, each face 64 may define a specific number of ports 18, for example one, two or more ports 18 within each angulated face 64. Other launch head designs may include for example, launch heads having one or more convex and/or concave faces. The launch head 60 shown is designed to effect a random pattern of paintball dispersion.

Notably, although the Drawings show launch heads 12 with generally planar, rectangular faces, it should be appreciated that rounded faces, curved faces or other face shapes and surface contours may alternatively be provided.

Figure 9A:
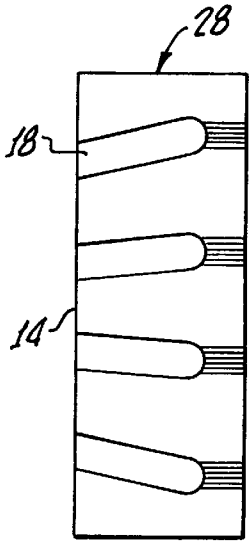
FIG. 9A represents a cross section of a launch head including ports disposed at converging angles to one another to effect a generally focused dispersion of paintballs.
Figure 9:
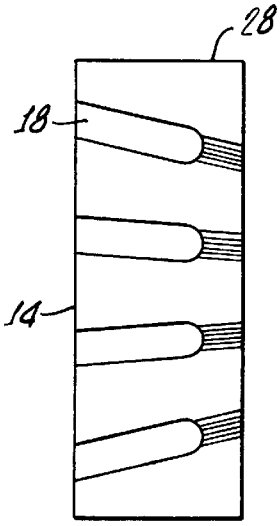
FIGS. 8 and 9 shows different cross sectional views of the launch head shown in FIG. 4, to show a feature of the present invention in which the ports are disposed at angles to one another to effect a broad dispersion of paintballs.
Figure 8:
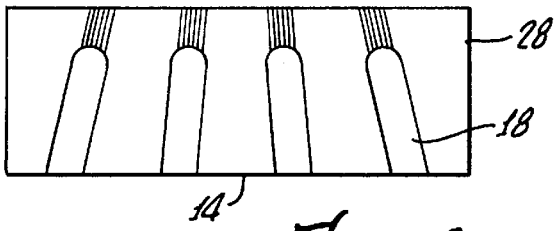

Turning now to FIGS. 8 and 9, it is shown that rather than the ports 18 being aligned parallel to one another and perpendicular to the launch head face 14 (such as shown in FIG. 3), the plurality of ports 18 may be disposed at angles to one another to effect different angles and spans of paintball projection. For example, the ports 18 may be disposed in diverging or converging angles to one another within said launch head 12, in order to effect a wide dispersion or a relatively focused dispersion of paintballs respectively.

FIGS. 8 and 9 show cross sectional views of the ports 18 of the launch head 12 of FIG. 4, in which the ports are generally divergent to one another to effect a wide dispersion of paintballs toward a target. Obviously, this feature may be desirable in a "Paintball" game situation where a wide playing field is used or where many opponents (i.e. potential targets) are simultaneously approaching the player/operator from a wide span.

FIG. 9A shows an example of a cross section taken from a different launch head cartridge 28 having multiple, generally converging ports 18.

Figure 10:
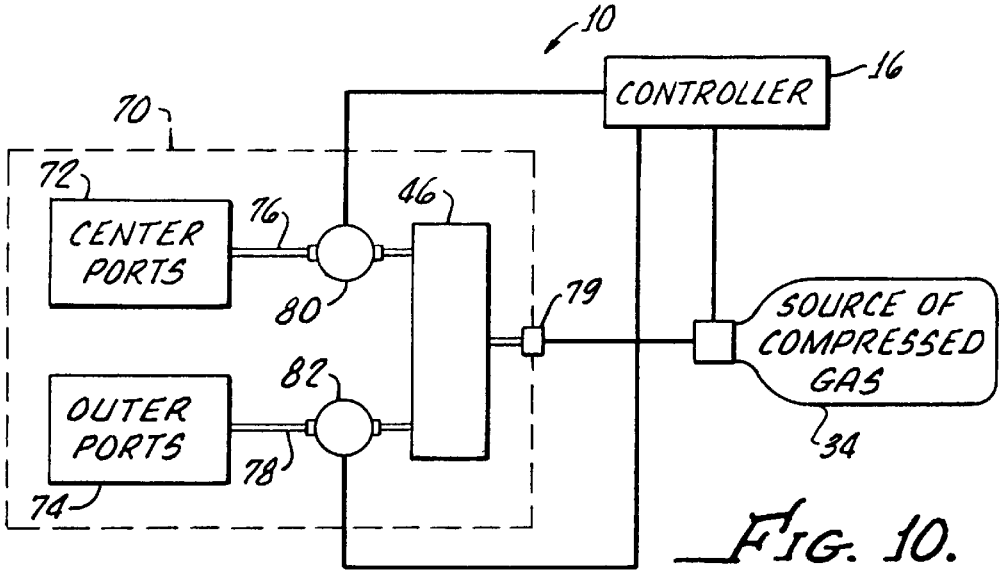
FIG. 10 shows a diagram of a paintball launching device in accordance with the invention which enables selective discharge of individual or subgroups of paintballs.

Turning now briefly to FIG. 10, a structural diagram is shown representing another feature of the present invention which enables selective launching of individual or subgroups of paintballs. For example, a launch head 70 may be provided which includes a concentric port arrangement having both center ports 72 and outer ports 74 disposed therein (see for example FIG. 5 which illustrates a concentric port arrangement).

Although disposed in a common launch head 70, the center ports 72 and the outer ports 74 make up distinct subgroups of ports having distinct advantages, and each subgroup may therefor be operated independently. Referring back now to FIG. 10, this feature may be provided as shown. Flow lines 76, 78 are connected between the plenum 46 and the center ports 72 and outer ports 74 respectively. The plenum 46 is coupled to the source of compressed gas 34 by suitable means 79. Valves 80, 82 are coupled to the flow lines 76, 78 respectively. Each valve 80, 82 may electronically or manually opened or closed independently of the other, thus enabling an operator to launch either only those paintballs in the center ports 72 (by opening valve 80 and closing valve 82) or only those paintballs in the outer ports 74 (by opening valve 82 and closing valve 80) for example. Alternatively, if both valves 80,82 have been opened, all of the paintballs will be simultaneously launched upon actuation of the device 10. The valves 80, 82 may be electronically operable by means of the controller 16 as shown, or they may simply be manually opened and closed by means of knobs or the like (not shown) mounted on the launch head 70.

The advantages of the feature hereinabove described and shown in FIG. 10 will be readily appreciated by those familiar with the game of "Paintball". If an operator of the present device 10 is unable to accurately judge the approach of an opponent, or several opponents are approaching simultaneously, he may choose to launch paintballs disposed in ports adapted for effecting a broad dispersion thereof, for example the outer ports 74. On the other hand, if a single opponent is sighted and the operator believes he is able to accurately judge the position thereof, he may choose to conserve paintballs and fire only those few paintballs disposed in the center ports 72 for example.

Figure 11:
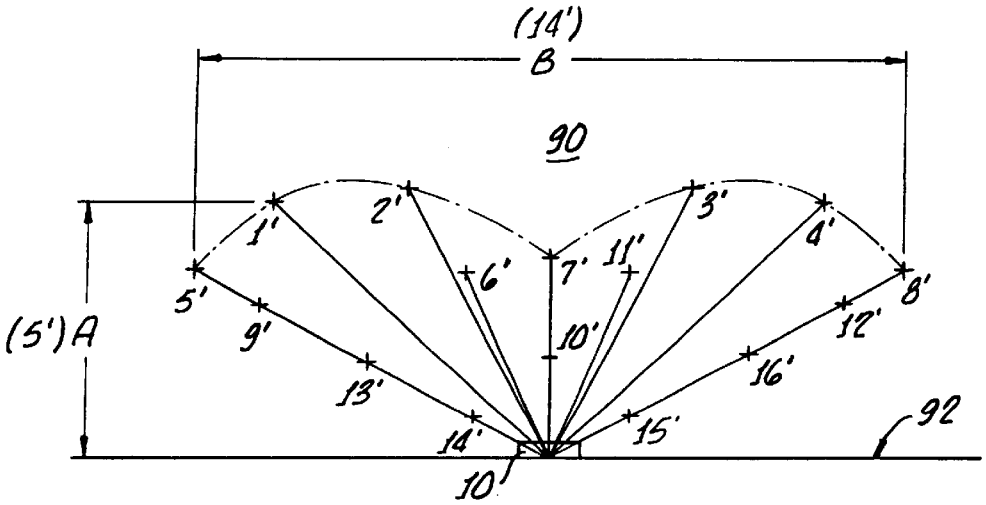
FIG. 11 shows a face view plot of a vertical wall that has been marked by paintballs launched simultaneously toward the wall by means of a multiport paintball launching device in accordance with the present invention.
Figure 12:
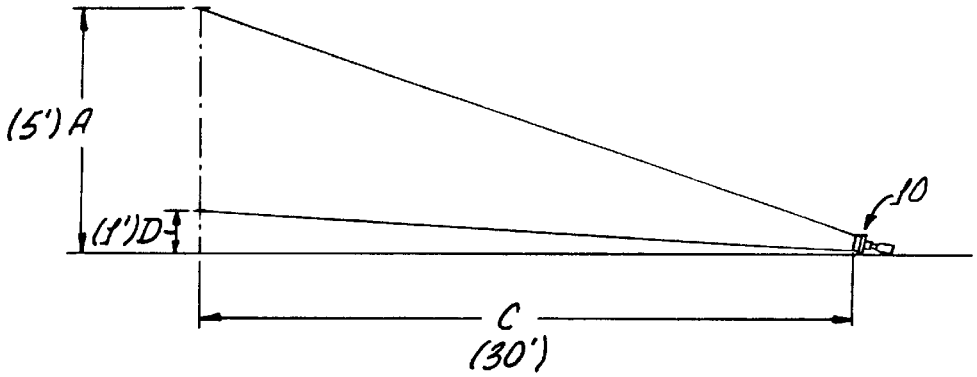
FIG. 12 shows a side view plot of the vertical wall shown in FIG. 11

Turning now to FIGS. 11 and 12, data collected from actual operation of the a paintball launching device 10 in accordance with the invention is presented. The paintball launching device used included a launch head having about a 5 inch by 5 inch square face and a 4×4 matrix of generally divergent ports (16 ports total) therein. Ports were approximately 1.5 inches deep and made to accommodate a paintball of about 0.35 inch radius. In FIG. 11, each paintball mark is numbered 1'–16' to represent a paintball that was launched from a corresponding port 1"–16" in the matrix arrangement shown in FIG. 4. FIG. 11 plots the sixteen paintball marks 1'–16' made against a vertical wall 90 (in plane of the page) upon a substantially simultaneous launch of the paintballs from the device 10. Numeral 92 represents ground level. As shown, the span of paintballs, represented by A and B respectively, is about 14 feet wide and about 5 feet in height. The device 10 was positioned at ground level 92 at a distance C of about 30 feet from the vertical wall. FIG. 12 represents a side view of the same launch event, showing that all paintball marks on the wall were made between about height D, 12 inches (1 foot) to about height A, 60 inches (5 feet) above ground level 92.

Although there has been hereinabove described a multiport paintball projecting device, in accordance with the present invention, for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A paintball launching device comprising:

a launch head;

a plurality of port means, disposed in said launch head, for receiving a paintball;

expulsion means, disposed in an operative relationship with the launch head, for launching the received paintball from each port means the expulsion means includes flow lines means comprising a plurality of separate flow lines connected to each of the plurality of port means; and control means, connected to said expulsion means, for controlling the launch of paintballs from each port means wherein the control means includes a plurality of individually operable valve members on each separate flow line, to enable selective launching of paintballs from the port means.

2. The device according to claim 1 wherein said launch head includes a face and said plurality of port means are disposed in a side by side relationship on said face.

3. The device according to claim 2 wherein the plurality of port means define a matrix pattern on said face.

4. The device according to claim 2 wherein the plurality of port means define a generally circular pattern on said face.

5. The device according to claim 1 wherein the plurality of port means define a generally triangular pattern on said face.

6. The device according to claim 1 wherein the plurality of port means are disposed generally parallel to one another within said launch head.

7. The device according to claim 1 wherein the plurality of port means are disposed at diverging angles to one another within said launch head to effect a broad dispersion of paintballs.

8. The device according to claim I wherein the plurality of port means are disposed at converging angles to one another within said launch head to effect a substantially focused dispersion of paintballs.

9. The device according to claim 1 further comprising means for enabling launch of the received paintballs with different ranges of flight from said plurality of port means.

10. The device according to claim 9 wherein the means for enabling launch of received paintballs with different ranges comprises port means of different depths.

11. The device according to claim 1 wherein said launch head includes a plurality of faces disposed at angles to one another and said plurality of port means are disposed in the angulated faces.

12. The device according to claim 1 wherein said expulsion means comprises means for connecting the launch head with a source of compressed gas.

13. The device according to claim 12 wherein the expulsion means further comprises a manifold, disposed in the launch head, including said flow line means for connecting the source of compressed gas with each of the port means.

14. The device according to claim 13 further comprising means for enabling launch of received paintballs with different ranges of flight.

15. The device according to claim 14 wherein the means for enabling launch of received paintballs with different ranges comprises different diameter flow line means.

16. The device according to claim 15 wherein the means for enabling launch of received paintballs with different ranges comprises different length flow line means.

17. The device according to claim 1 wherein the control means comprises an remote actuator capable of transmitting signals, and said expulsion means comprises a receiver adapted to respond to the transmitted signals, to enable remote actuated launching of paintballs from the port means.

18. A paintball launching device comprising:

a launch head including a base, member and a plurality of cartridges removably and interchangeably coupled to the base member, each cartridge including port means for receiving a paintball;

expulsion means for launching the paintball from the at least one port of the cartridge coupled to the base member the expulsion means includes flow lines means comprising a plurality of separate flow lines connected to each port means; and control means, connected to said expulsion means, for controlling the launch of the received paintball wherein the control means includes a plurality of individually operable valve members on each separate flow line, to enable selective launching of paintballs from the port means.

19. The device according to claim 18 wherein the port means in each cartridge includes a plurality of ports.

20. The device according to claim 18 wherein the base member is adapted to accommodate more than one cartridge of said plurality of cartridges at a time.

21. The device according to claim 18 wherein the expulsion means includes means for connecting the launch head with a source of compressed gas.

22. The device according to claim 21 wherein the expulsion means further comprises a manifold, disposed in the launch head, including said flow line means for connecting the source of compressed gas with the port means.

23. A paintball launching device comprising:

a launch head having a face;

a plurality of ports on the face, the plurality of ports adapted to receive paintballs;

a manifold within said launch head and connected to each of the plurality of ports;

a launching mechanism adapted to propel the paintballs from the plurality of ports, the launching mechanism including means for connecting the manifold to a source of compressed gas; and a controller adapted to enable operator controlled actuation of the launching mechanism.

* * * * *